US006132260A

United States Patent [19]

Wu

[11] Patent Number: 6,132,260

[45] Date of Patent: Oct. 17, 2000

[54] MODULAR CONNECTOR ASSEMBLY

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/372,182

[22] Filed: Aug. 10, 1999

[51] Int. Cl.[7] ..... H01R 24/00

[52] U.S. Cl. ..... 439/676; 439/620

[58] Field of Search ..... 439/620, 676, 439/541.5, 701, 76.1, 79

[56] References Cited

U.S. PATENT DOCUMENTS

| | | | |
|---|---|---|---|
| 5,531,612 | 7/1996 | Goodall et al. | 439/541.5 |
| 5,639,267 | 6/1997 | Loudermilk | 439/676 |
| 5,709,568 | 1/1998 | Pan et al. | 439/541.5 |
| 5,940,959 | 8/1999 | Caveney et al. | 439/620 |

*Primary Examiner*—Gary F. Paumen
*Attorney, Agent, or Firm*—Wei Te Chung

[57] ABSTRACT

A stacked connector assembly comprises a dielectric main housing, a mating member, a connecting member and a middle circuit board for electrically connecting the mating member with the connecting member. The middle circuit board forms a plurality of contact fingers for engaging with corresponding mating contacts retained in the mating member, and a plurality of holes for engaging with corresponding connecting terminals retained in the connecting member. Thus, the middle circuit board electrically connects the mating member with the connecting member thereby forming a subassembly. Moreover, electronic elements could be mounted on the middle circuit board for performing certain functions, such as grounding, anti-cross-talk, filtering impure signal, etc., thereby improving the performance of the stacked connector assembly. The subassembly is then guidably inserted into a receiving chamber defined in the main housing by a pair of guiding rails formed on inner surfaces of opposite side walls of the main housing. Upper and lower mating openings are defined in a front face of the main housing and are separated by a partition integrally connected with the opposite side walls for insertion of a mating connector.

12 Claims, 5 Drawing Sheets

MODULAR CONNECTOR ASSEMBLY

BACKGROUND OF THE INVENTION

The present invention relates to a stacked connector assembly for transmitting high frequency signals, and particularly to a stacked connector assembly having multiple mating ports for engaging with corresponding mating connectors and modular members which can be easily assembled together.

The number of peripheral instruments of a computer increases, two or more modular connectors are usually designed to form an integral connector assembly thereby simplifying assembly of the modular connectors. Such a stacked connector assembly is commonly an elongate combination of several horizontally stacked modular connectors. The elongate stacked connector assembly is then fixed to an edge of a mother board of a computer. However, a dimension of the edge of the mother board of the computer is limited, and the length of the stack integral connector assembly is thus limited by the dimension of the edge of the mother board.

Another conventional stacked connector assembly as disclosed in U.S. Pat. No. 5,531,612 and Taiwan Patent Application No. 84109709 is adopted for solving the problem described above. The stacked connector assembly is designed to stack a plurality of modular connectors in a juxtaposed manner, while simultaneously stacking another plurality of modular connectors in an overlapping manner. The integral connector assembly commonly comprises a main housing, a plurality of upper inserting members and a plurality of lower inserting members. Each of the upper and lower inserting members comprises a plurality of insert molded terminals for signal transmission therethrough. However, the separated upper and lower inserting members are required to be fixed within the main housing thereby complicating assembly.

In addition, a front shield member and a rear shield member are usually assembled to shield the main housing of the stacked connector assembly disclosed in U.S. Pat. No. 5,531,612. However, the front and rear shell members cannot sufficiently prevent cross-talk between the terminals of the upper and lower inserting members. Thus, a middle shell is provided to be fixed between the upper and lower inserting members for preventing cross-talk between the terminals of the upper and lower inserting members, thereby resulting in a complex structure of the main housing and a complicated assembly process. Moreover, such a stacked connector assembly does not prevent cross-talk nor does it filter interferential signal communication therethrough resulting from the high frequency characteristics of the stacked connector assembly.

BRIEF SUMMARY OF THE INVENTION

A main object of the present invention is to provide a stacked connector assembly having modular members integrally assembled together via a middle circuit board for providing good high frequency performance and for achieving multi-functions thereof.

A stacked connector assembly in accordance with the present invention comprises a dielectric main housing, a mating member, a connecting member and a middle circuit board for electrically connecting the mating member with the connecting member. The middle circuit board forms a plurality of contact fingers for engaging with corresponding mating contacts retained in the mating member, and a plurality of holes for engaging with corresponding connecting terminals retained in the connecting member. Thus, the middle circuit board electrically connects the mating member with the connecting member thereby forming a subassembly. Moreover, electronic elements can be mounted on the middle circuit board for performing certain functions, such as grounding, anti-cross-talk, filtering impure signals, etc., thereby improving performance of the stacked connector assembly. The subassembly is then guidably inserted into a receiving chamber defined in the main housing by a pair of guiding rails formed on inner surfaces of opposite side walls of the main housing. An upper and a lower mating openings are defined in a front face of the main housing and are separated by a partition integrally connected with the opposite side walls. The receiving chamber is in communication with the upper and lower mating openings. The mating member of the subassembly is positioned by the partition and the guiding rails for engaging with the mating connector.

Other objects, advantages and novel features of the invention will become more apparent from the following detailed description when taken in conjunction with the accompanying drawings.

DETAILED DESCRIPTION OF THE INVENTION

Figure 1:
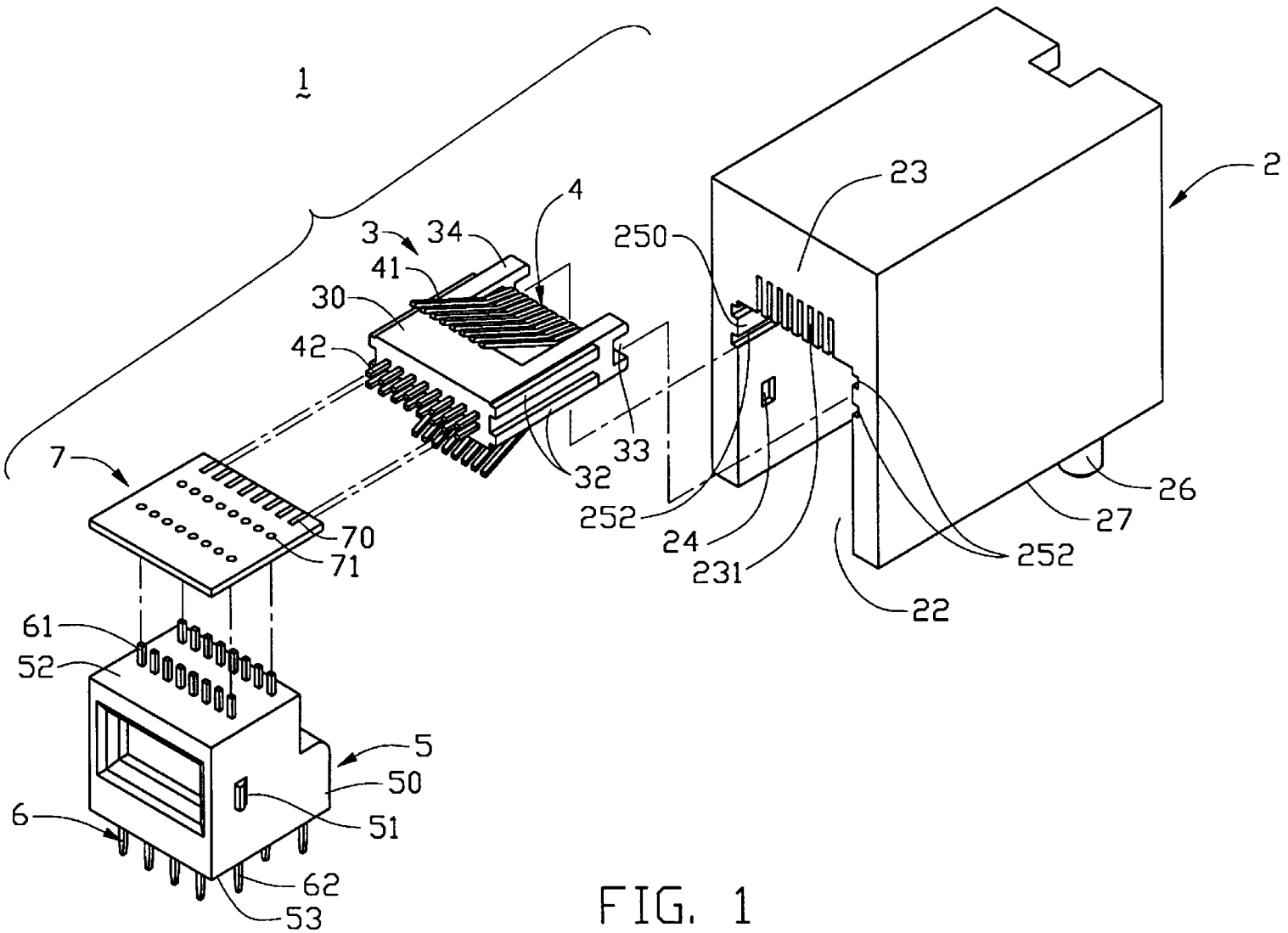
FIG. 1 is an exploded view of a modular connector assembly of the present invention.
Figure 2:
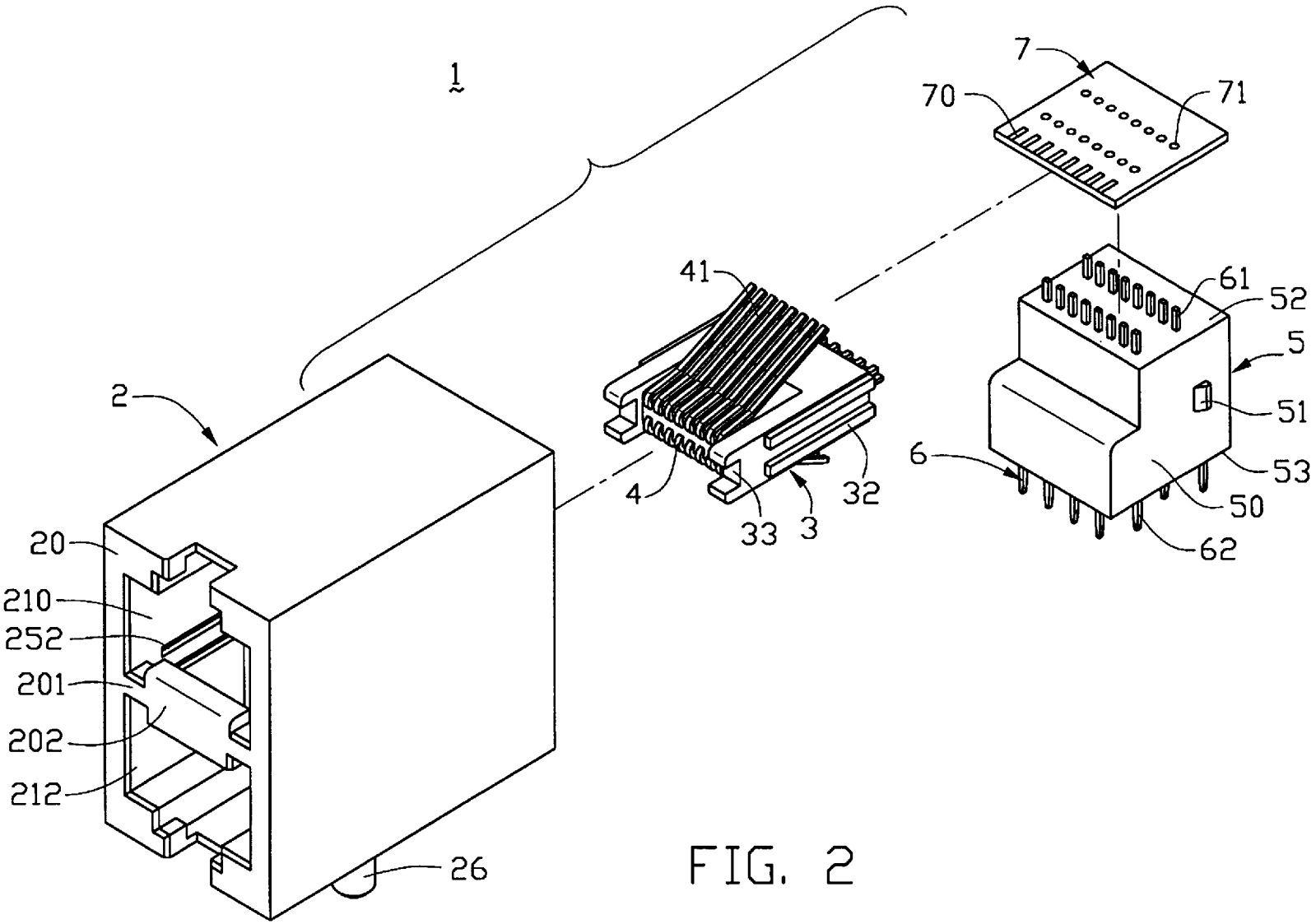
FIG. 2 is another exploded view of the modular connector assembly.

Referring to FIGS. 1 and 2, a stacked connector assembly 1 in accordance with the present invention comprises a main housing 2, a mating member 3, a connecting member 5 and a middle circuit board 7. The middle circuit board 7 electrically connects the mating member 3 with the connecting member 5 thereby forming a subassembly 1' (FIG. 3) for being integrally inserted into the main housing 2.

The main housing 2 defines upper and lower mating openings 210, 212 in a front face 20 for insertion of corresponding mating connectors (not shown). The upper and lower mating openings 210, 212 are separated by a partition 201 formed on the front face 20 and integrally connecting opposite side walls of the main housing 2. The partition 201 forms an expanded middle portion 202. A receiving chamber 22 is defined in the main housing 2 and exposed to a rear face 23 and a bottom face 27 of the main housing 2 in communication with the upper and lower mating openings 210, 212. A pair of guiding rails 250 is formed on inner surfaces of the opposite side walls of the main housing 2 between the front and rear faces 20, 23 for guiding the mating member 3 to enter into the receiving chamber 22. A pair of guiding grooves 252 is defined in opposite sides of each guiding rail 250 for cooperating with the guiding rails 250 to guide insertion of the mating member 3 and for positioning the mating member 3. A pair of recesses 24 is defined in the inner surfaces of the opposite side walls for engaging the connecting member 5. A pair of board locks 26 downwardly extends from the bottom face 27 of the main housing 2 for connecting with a mother board (not shown). A plurality of channels 231 is defined in a top wall of the main housing 2 and exposed to the rear face 23 in communication with the receiving chamber 22.

The mating member 3 comprises a dielectric main body 30 retaining a plurality of mating contacts 4 arranged in upper and lower rows. Each mating contact 4 comprises a soldering section 42 for engaging with the middle circuit board 7, an engaging section (not shown) for securing within the main body 30 and a contact section 41 for electrically contacting corresponding contacts of a mating connector (not shown). The soldering sections 42 of the mating contacts 4 of the upper row extend beyond the main body 30 from one end, while the contacting sections 41 extend beyond the main body 30 from the other end and are bent an appropriate angle. The arrangement of the mating contacts 4 of the lower row is a mirror image of the mating contacts 4 of the upper row. A pair of projections 34 integrally extends from opposite sides of the main body 30. A cutout 33 is defined in a free end of each projection 34 for engaging with the partition 201 of the main housing 2. A pair of elongate guiding ribs 32 is formed on each side of the main body 30 for engaging with the corresponding guiding grooves 252 of the main housing 2.

The connecting member 5 comprises a dielectric housing body 50 retaining a plurality of connecting terminals 6 therein. A pair of engaging tabs 51 is formed on outer surfaces of opposite side walls of the housing body 50 for engaging with the corresponding recesses 24 of the main housing 2. Each connecting terminal 6 comprises a soldering portion 61 for engaging with the middle circuit board 7, an engaging portion (not shown) for securing within the housing body 50, and a connecting portion 62 for electrically connecting with the mother board. The soldering portions 61 of the connecting terminals 6 are arranged in two rows and extend beyond a top surface 52 of the housing body 50, while the connecting portions 62 are arranged in four rows and extend beyond a bottom surface 53 of the housing body 50.

The middle circuit board 7 comprises an inner circuit (not shown) and a plurality of electronic elements (not shown) for performing certain functions, such as grounding, anti-cross-talk, filtering impure signal, etc. A plurality of aligned contact fingers 70 is formed on opposite surfaces of the middle circuit board 7 for engaging with the corresponding upper and lower rows of the mating contacts 4 of the mating member 3. Two rows of through holes 71 are defined in the middle circuit board 7 for engaging with the connecting terminals 6 of the connecting member 5. The thickness of the middle circuit board 7 is substantially equal to the distance between the upper and lower mating contacts 4 of the mating member 3.

Figure 3:
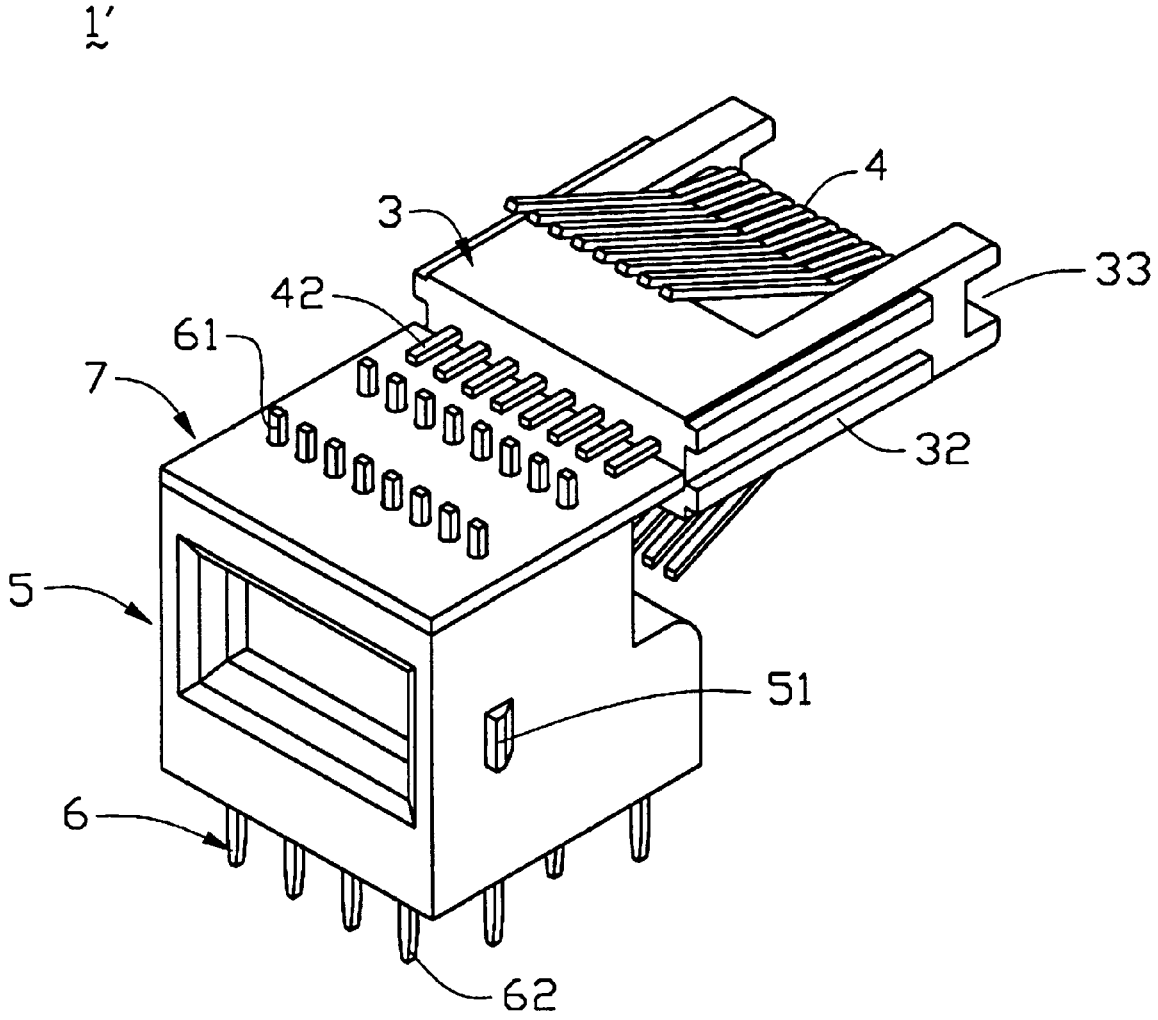
FIG. 3 is an assembled view of a middle circuit board, a mating member and a solder member of the modular connector assembly.

Referring to FIG. 3, in assembly, the mating member 3, the middle circuit board 7 and the connecting member 5 are assembled together to form the subassembly 1' for being integrally inserted into the receiving chamber 22 of the main housing 2. The soldering portions 61 of the connecting terminals 6 of the connecting member 5 are soldered into the corresponding holes 71 of the middle circuit board 7 thereby electrically connecting the connecting member 5 with the middle circuit board 7. The middle circuit board 7 is then partially sandwiched between the upper and lower rows of the mating contacts 4 of the mating member 3 whereby the contact fingers 70 of the middle circuit board 7 electrically contact the connecting sections 42 of the corresponding mating contacts 4.

Figure 4:
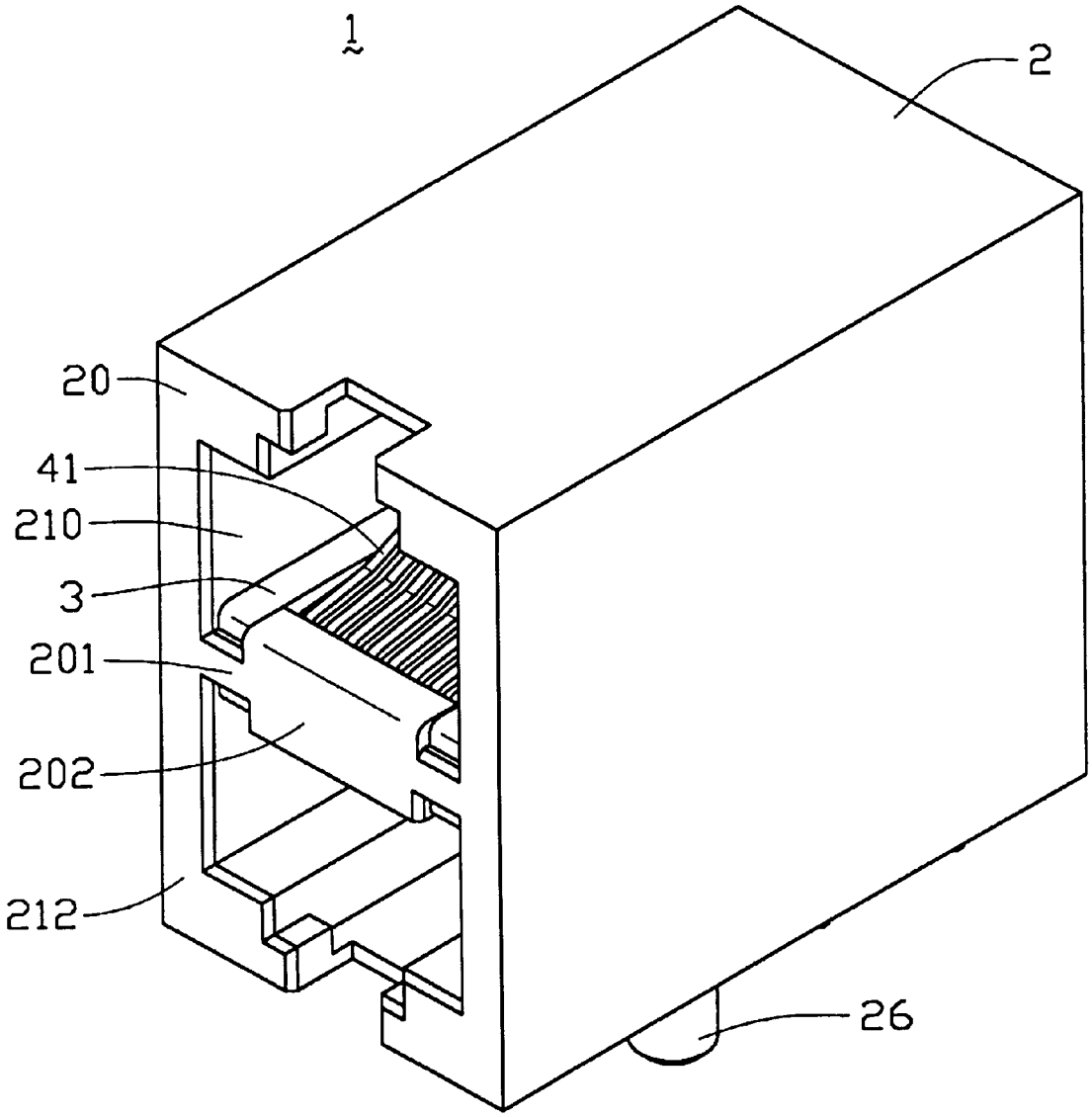
FIG. 4 is an assembled view of FIG. 1.
Figure 5:
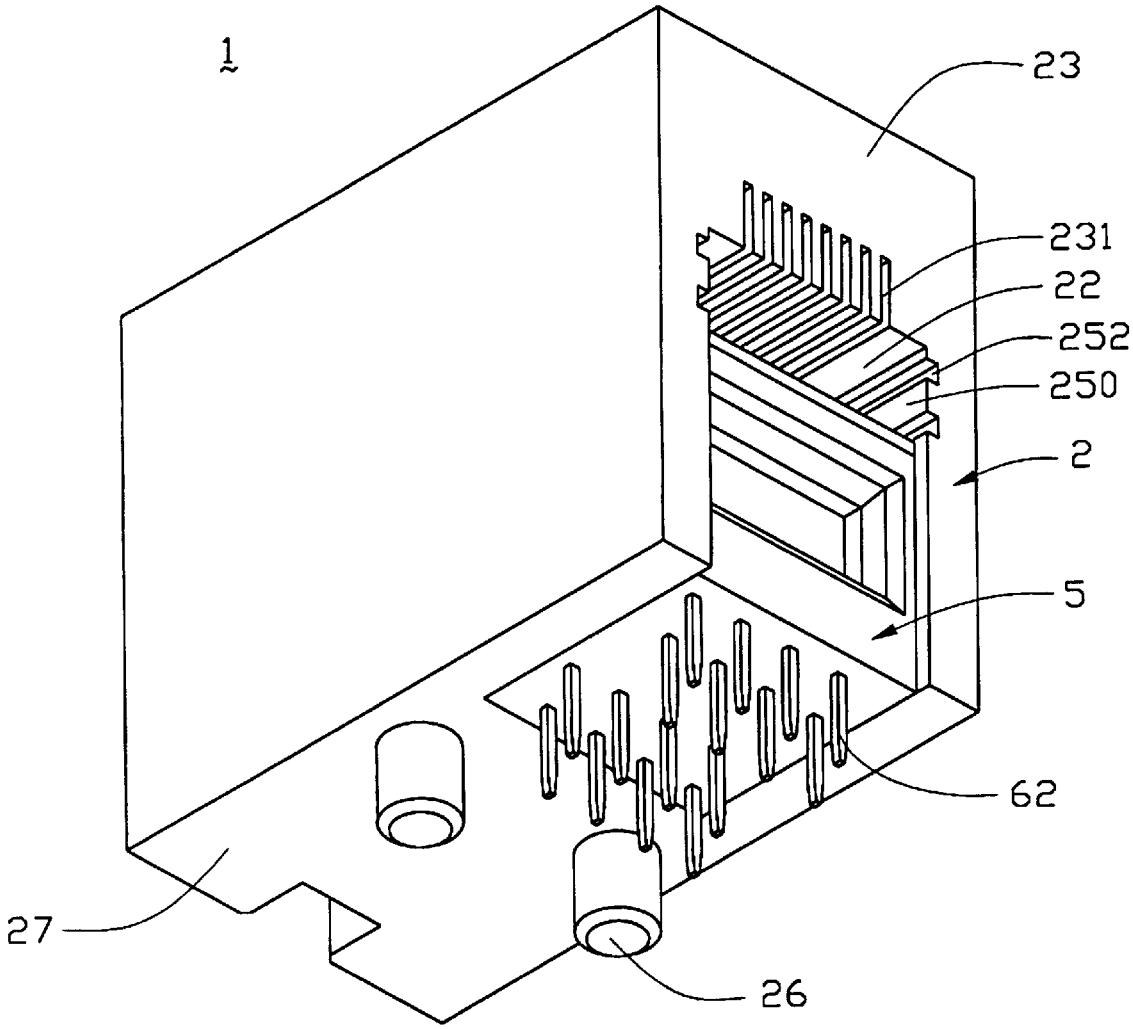
FIG. 5 is another assembled view of FIG. 1.

Referring further to FIGS. 4 and 5, the subassembly 1' is inserted into the receiving chamber 22 of the main housing 2. The guiding rails 250 are sandwiched between the corresponding pair of elongate guiding ribs 32 while the elongate guiding ribs 32 slidably engage with the corresponding guiding grooves 252 of the main housing 2. The mating member 3 is driven to abut against the middle portion 202 of the partition 201 via guidance of the guiding rails 250 and the guiding grooves 252. The cutouts 33 of the projections 34 simultaneously engage with the partition 201. The curved contact sections 41 of the mating contacts 4 of the upper row of the mating member 3 engage with the corresponding channels 231 of the main housing 2 well above the partition 201, while the curved contact sections 41 of the mating contacts 4 of the lower row extend into the receiving chamber 22 below the partition 201. The engaging tabs 51 of the connecting member 5 engage with the corresponding recesses 24 of the main housing 2. Thus, the subassembly 1' is securely received within the receiving chamber 22 of the main housing 2.

A housing member (not shown) could also be manufactured to comprise more than one main housing 2 while each main housing 2 securely receives the subassembly 1'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked connector assembly comprising:

a main housing having a receiving chamber exposed to a rear face and a bottom face thereof, upper and lower mating openings defined in a front face and in communication with the receiving chamber for insertion of a mating connector therethrough, and a partition integrally connected between opposite side walls of the main housing for separating the upper mating opening from the lower mating opening; and a subassembly being guidably inserted within the receiving chamber of the main housing, the subassembly comprising a mating member retaining a plurality of mating contacts for electrically engaging with mating connectors, a connecting member retaining a plurality of connecting terminals, and a middle circuit board electrically connecting the mating contacts of the mating member with the connecting terminals of the connecting member and carrying a plurality of filtering electronic elements thereon;

wherein the mating contacts comprise contact sections and soldering sections extending from the mating member, and are arranged in upper and lower rows, the contact sections of the upper and lower rows of mating contacts extending into the receiving chamber and respectively facing corresponding upper and lower mating openings, the middle circuit board being sandwiched between the upper and lower rows of soldering sections of the mating contacts for electrically connecting with the mating member.

2. The stacked connector assembly as claimed in claim 1, wherein a pair of guiding rails is respectively formed on opposite inner surfaces of the side walls for guiding the subassembly to be inserted into the receiving chamber of the main housing.

3. The stacked connector assembly as claimed in claim 2, wherein a pair of guiding grooves is defined in opposite sides of each guiding rails of the main housing for guiding the subassembly into the receiving chamber.

4. The stacked connector assembly as claimed in claim 3, wherein a pair of elongate guiding ribs is formed on each opposite side of the mating member for slidably engaging with corresponding guiding grooves of the main housing.

5. The stacked connector assembly as claimed in claim 1, wherein the middle circuit board forms a plurality of aligned contact fingers on opposite surfaces thereof for electrically engaging with corresponding soldering sections of the mating member.

6. The stacked connector assembly as claimed in claim 5, wherein a thickness of the middle circuit board is substantially equal to a distance between the upper and lower rows of the soldering sections of the mating contacts.

7. The stacked connector assembly as claimed in claim 1, wherein the middle circuit board defines two rows of aligned holes for electrically engaging with the connecting member.

8. The stacked connector assembly as claimed in claim 7, wherein each connecting terminal of the connecting member comprises a soldering portion outwardly extending from the connecting member for electrically engaging with a corresponding hole of the middle circuit board, and a connecting portion downwardly extending from the connecting member opposite the soldering portion for electrically connecting with a mother board.

9. The stacked connector assembly as claimed in claim 1, wherein a pair of projections outwardly extends from opposite sides of the mating member, and wherein a cutout is defined in each projection for engaging with the partition of the main housing.

10. The stacked connector assembly as claimed in claim 1, wherein the connecting member forms a pair of engaging tabs on opposite sides thereof for engaging with the main housing, and wherein the main housing defines a pair of recesses in the inner surfaces of the opposite side walls for engaging with corresponding engaging tabs.

11. The stacked connector assembly as claimed in claim 1, wherein a plurality of aligned channels is defined in a top wall of the main housing in communication with the receiving chamber for properly separating and positioning the contact sections of the mating contacts.

12. The stacked connector assembly as claimed in claim 1, wherein a pair of board locks downwardly extends from the bottom face of the main housing for connecting to a mother board.

* * * * *